US009968517B2

(12) United States Patent
Lopez Losada et al.

(10) Patent No.: US 9,968,517 B2
(45) Date of Patent: May 15, 2018

(54) TUBE FOR STORING UNIT DOSES OF A DRUG, METHOD AND DEVICE FOR FILLING SAME AND DISPENSING CABINET USING SAME

(75) Inventors: Rafael Maria Lopez Losada, Madrid (ES); José Maria Argüello Martinez, Madrid (ES); Josep Monterde Junyent, Madrid (ES); Julio Martinez Cutillas, Madrid (ES)

(73) Assignee: Isish Healthcare System, S.L., Madrid (ES)

( * ) Notice: Subject to any disclaimer, the term of this patent is extended or adjusted under 35 U.S.C. 154(b) by 942 days.

(21) Appl. No.: 14/357,050

(22) PCT Filed: Nov. 8, 2011

(86) PCT No.: PCT/ES2011/000326

§ 371 (c)(1),
(2), (4) Date: Sep. 12, 2014

(87) PCT Pub. No.: WO2013/068604

PCT Pub. Date: May 16, 2013

(65) Prior Publication Data

US 2015/0041355 A1 Feb. 12, 2015

(51) Int. Cl.
*G07F 17/00* (2006.01)
*A61J 1/03* (2006.01)
(Continued)

(52) U.S. Cl.
CPC ..... *A61J 1/035* (2013.01); *A61J 7/0076* (2013.01); *B65B 5/04* (2013.01); *B65B 35/02* (2013.01);
(Continued)

(58) Field of Classification Search
CPC ..... G07F 11/18; G07F 11/38; G07F 17/0092; A61J 7/0076; A61J 1/035
(Continued)

(56) References Cited

U.S. PATENT DOCUMENTS 4,192,422 A * 3/1980 Kotyuk ..... A61J 1/035 206/1.5
4,426,425 A * 1/1984 Good ..... C08G 59/64 428/414
(Continued)

FOREIGN PATENT DOCUMENTS

EP 1241617 A2 9/2002

OTHER PUBLICATIONS

International Search Report dated May 31, 2012, relating to International Application No. PCT/ES2011/000326.

*Primary Examiner* — Timothy R Waggoner
(74) *Attorney, Agent, or Firm* — Honigman Miller Schwartz and Cohn LLP

(57) ABSTRACT

Tubes for storing unit doses of drugs are disclosed, the tubes may include an elongate outer casing having two open ends, an inner structure inside said casing, which includes two opposite symmetrical walls connected at the ends thereof and ribbed on the inner surfaces thereof such as to enable the insertion and fastening of a blister pack containing a unit dose of a drug in channels opposite to said walls, and a pulling means for inserting and extracting the inner structure from the outer casing. Devices and methods for filling the tube with unit doses of drugs is also disclosed, along with cabinets for dispensing unit doses of drugs from said storage tube.

15 Claims, 7 Drawing Sheets

(51) Int. Cl.

| | |
|---|---|
| ***G07F 11/38*** | (2006.01) |
| ***A61J 7/00*** | (2006.01) |
| ***B65B 5/04*** | (2006.01) |
| ***B65B 35/02*** | (2006.01) |
| ***B65B 61/26*** | (2006.01) |

(52) U.S. Cl.
CPC ..... *B65B 61/26* (2013.01); *G07F 11/38* (2013.01); *G07F 17/0092* (2013.01)

(58) Field of Classification Search
USPC ..... 206/530
See application file for complete search history.

(56) References Cited

U.S. PATENT DOCUMENTS 5,368,187 A * 11/1994 Poncetta ..... B65B 69/0058 206/531
5,392,951 A * 2/1995 Gardner ..... E05B 65/46 221/125
5,927,540 A 7/1999 Godlewski
6,109,774 A * 8/2000 Holmes ..... G07F 11/62 221/12
6,394,306 B1 * 5/2002 Pawlo ..... A61J 7/0409 221/15
7,316,328 B2 * 1/2008 Yuyama ..... G07F 11/165 221/227
7,896,149 B2 * 3/2011 Tabata ..... G07D 1/02 194/217
8,083,078 B2 * 12/2011 Omura ..... B65G 1/06 211/51
8,145,353 B1 * 3/2012 Cotner ..... G07F 11/62 700/236
8,733,217 B2 * 5/2014 Yuyama ..... G07F 17/0092 221/1
8,744,621 B2 * 6/2014 Michael ..... E05B 47/00 221/122
9,387,148 B2 * 7/2016 Rosenbaum ..... A61J 1/035
9,511,945 B2 * 12/2016 Greyshock ..... B65G 35/00
2008/0051937 A1 2/2008 Khan et al.
2008/0264967 A1 10/2008 Schifman et al.
2009/0224638 A1 9/2009 Weber
2010/0089997 A1 4/2010 Carson et al.

* cited by examiner

TUBE FOR STORING UNIT DOSES OF A DRUG, METHOD AND DEVICE FOR FILLING SAME AND DISPENSING CABINET USING SAME

FIELD OF THE INVENTION

The present invention relates generally to the field of storage and distribution systems of medications in unit doses.

TECHNICAL BACKGROUND

A widely recognized problem in the field of storage and distribution of medications is the mismatch between the amount of doses prescribed and the amount of doses supplied in their conventional packages. In many cases, medications are packaged and supplied in boxes comprising a given number of doses, a number that often exceeds the number of doses that a patient should receive for a given treatment. The result is that frequently the remaining doses of said medication either expire unused in the patient's home, or are destroyed (in many occasions by means of methods not suitable, being an important focus of environmental pollution).

In order to solve this problem, already in the 1940s the idea to develop distribution systems of medicines in unit doses was approached in the United States, applied specifically to hospitals. These systems consist in a series of guidelines and methodologies to be followed in hospitals in order to optimize the use of medications, and are currently implemented in most hospitals. However, these systems continue to entail substantial workload for the hospital staff, who must manually prepare the corresponding doses for each patient based on the prescriptions issued by the doctor.

Recently, automatic systems for dispensing medicines in unit doses have began to be proposed. These systems generally consist in distribution cabinets, similar to beverage vending machines, in which medicines are previously stored and that are only accessible by authorized personnel. These systems allow alleviating the workload borne by the hospital pharmacy, as those dispensing cabinets are distributed in the different floors of the hospital. However, the system still relies mostly on the manual work of the person responsible of each floor, which can be a source of errors and delays.

Thus, there remains a need in the art for an automatic system for dispensing unit doses of medications that is fast and reliable, and that allows to substantially reduce the workload imposed on doctors, nurses and pharmacists in hospitals. Furthermore, there is also the need for a dispensing system of such kind that allows its adaptation to external pharmacies, allowing at least partially solving the current problem of adjusting the number of doses in current medication packages to the number of doses prescribed by the doctor for an outpatient.

SUMMARY OF THE INVENTION

The present invention discloses, in a first aspect, a storage tube for unit doses of medications. Said storage tube comprises an outer casing of elongated parallelepiped shape with two open ends; an inner structure within said casing and traction means for inserting and extracting the inner structure from the outer casing. For its part, the inner structure comprises two opposite symmetrical walls joined at their ends and ribbed on their inner faces, so that a blister containing a unit dose of medication can be inserted and fastened in opposite channels of said walls. Therefore, said tube can store several unit dose blisters inserted between opposite channels of those walls of the inner structure. Said inner structure stays inserted into the outer casing in a storage position, and the necessary amount can be extracted therefrom, by traction means, to extract the required number of unit doses or to fill the inner structure with the required unit doses.

In a second aspect, the present invention also discloses a device for filling the storage tube for unit doses of medications according to the first aspect of the invention. Said filling device comprises a housing in which a storage tube for unit doses of medications is inserted; traction means for extracting the inner structure from the outer casing and for inserting the inner structure into the outer casing, respectively; and a conveyor belt for the arrival of blisters with unit doses of medications inside said inner structure. Therefore, the filling device allows extracting initially the inner structure from its outer casing, inserting blisters with unit doses of medications between opposite channels of the inner structure as described above, and finally inserting again the inner structure in its outer casing. Thus, the filling device, from a storage tube according to the first aspect of the invention, which is empty or substantially empty, provides a storage tube which is full or substantially full of unit doses of medications.

According to a third aspect, the present invention discloses a medication dispensing cabinet from storage tubes according to the first aspect of the invention. Said dispensing cabinet comprises

- an outer body;
- means for introducing information about the request of unit doses of medications;
- a plurality of housings, each housing being suitable for a storage tube for unit doses of medications;
- anchoring means of each storage tube in its respective housing;
- a hoist arranged to move to any of the plurality of housings according to the information about the request of unit doses of medications;
- traction means in said hoist to extract each inner structure from its outer casing of storage tube and respectively insert each inner structure into its outer casing;
- a conveyor belt joined in solidarity movement with said hoist;
- means for ejecting a blister with unit dose of medication from an inner structure of storage tube extracted by said traction means to said conveyor belt;
- a pair of clamps, being one of their ends inserted into a guide rail present in a lateral projection of said hoist;
- a collection bag held in open position by said clamps and arranged to receive unit doses of medications carried by said conveyor belt;
- closure means of said collection bag once all unit doses of medications have been introduced;
- writing means of a label with information about the unit doses of medications introduced into the collection bag;
- means for affixing the label to the collection bag; and
- an output channel of the closed bag outwards.

Therefore, it can be observed that the dispensing cabinet according to the present invention allows dispensing in a fully automated, reliable and accurate way, the exact number and type of unit doses prescribed by a doctor, with minimal intervention of the healthcare professionals.

Finally, a fourth and last aspect of the invention discloses a method of filling a storage tube according to the first aspect of the invention. This filling method comprises the steps of:

a) placing the storage tube in a fixed position;
b) extracting the inner structure from its outer casing;
c) introducing a blister with a unit dose of medication fastened between opposite channels of the walls of the inner structure;
d) inserting the inner structure into its outer casing a certain number of channels to provide sufficient space therein for the introduction of another blister with unit dose of medication; and
e) repeating steps c) and d) until the inner structure is completely inserted into its outer casing.

This method thus allows filling a storage tube for unit doses of medications, as described in the first aspect of the invention, with blisters containing said unit doses of medications. According to this method, the maximum utilization of the capacity of the storage tube is allowed, by determining the minimum number of free channels that must be left between two blisters to provide enough space for said blisters depending on their volume. The storage tubes provided by this method will therefore be ready to distribute medications in unit doses, preferably from a dispensing cabinet according to the third aspect of the present invention.

BRIEF DESCRIPTION OF THE FIGURES

The present invention will be better understood with reference to the following drawings which illustrate a preferred embodiment of the invention, provided as an example, and that should not be interpreted whatsoever as limiting of the invention.

DETAILED DESCRIPTION OF THE PREFERRED EMBODIMENT

As used in this document, the term "medication" should not be understood in its usual limited sense in the art. On the contrary, the term "medication" refers in this document to any drug or medical device susceptible to be supplied for the care and treatment of a patient in unit doses. Thus, the term "medication" in this document comprises equally pills, tablets, medication sachets, etc. . . . and also, for example, syringes that can be pre-filled or not, ampoules, vials, dressings, etc.

Figure 1A:
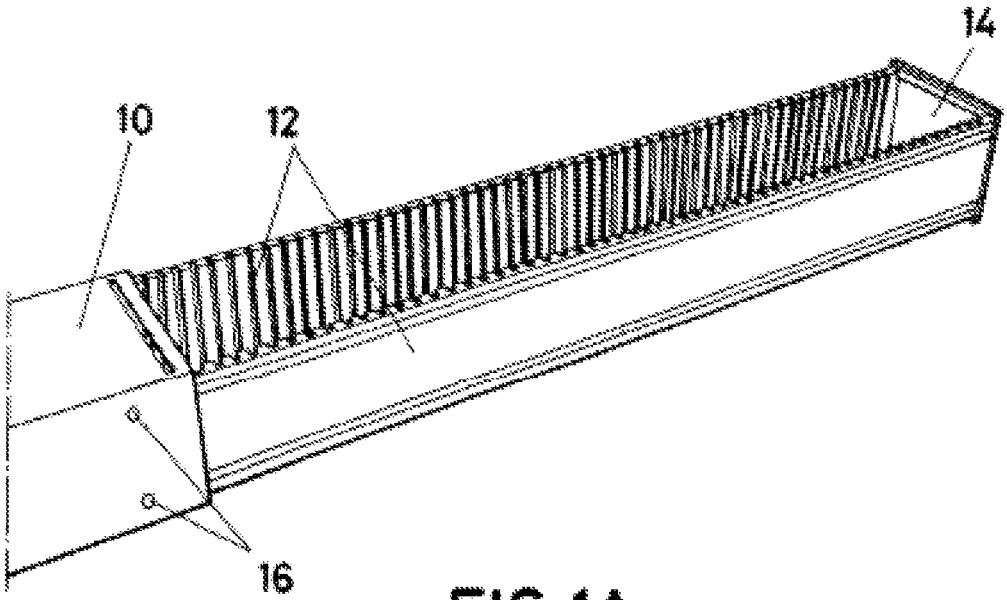
FIGS. 1A and 1B show two perspective views of a storage tube for unit doses of medications according to a preferred embodiment of the present invention.
Figure 1B:
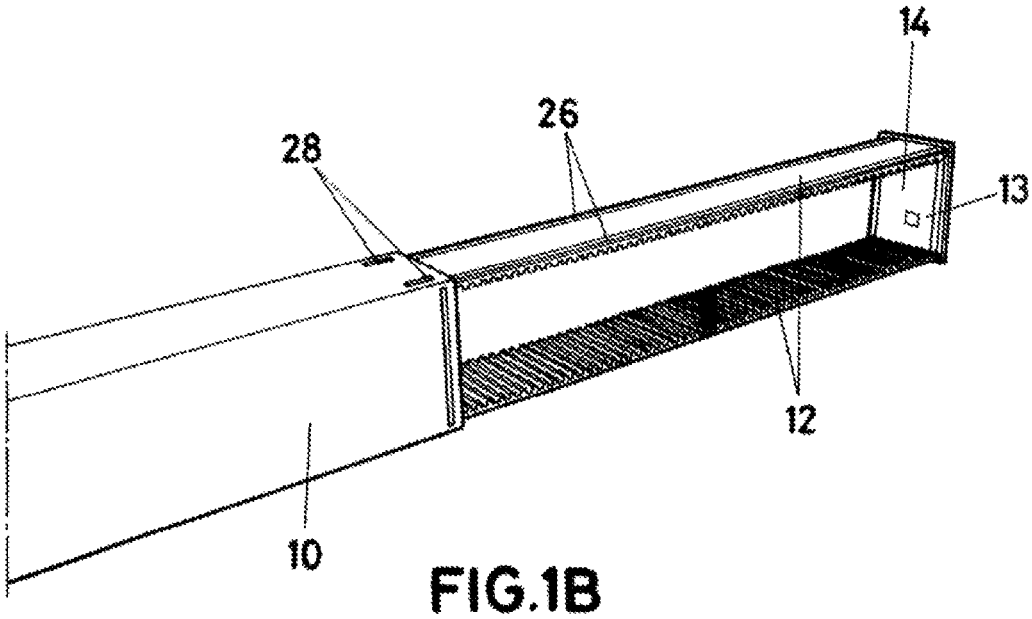

Making reference first to both FIGS. 1A and 1B, a storage tube for unit doses of medications is shown according to the preferred embodiment of the invention. Said storage tube comprises an outer casing (10), preferably of elongated parallelepiped shape, with two open ends; an inner structure within said casing (10); as well as traction means (not shown) for inserting and extracting the inner structure from the outer casing (10).

Furthermore, the inner structure comprises two opposite symmetrical walls (12), joined at their ends and ribbed on their inner faces, so that a blister (not shown in this figure) containing a unit dose of medication can be inserted and fastened in opposite channels of said walls (12).

As can be seen in these figures, the ends of the walls (12) of the inner structure are joined by solid plates (14) (only one is visible in the figures) that fulfill the function of tamper-proof lids of the storage tube in the position in which the inner structure is completely inserted into the outer casing (10). However, those skilled in the art will easily appreciate that in other embodiments other types of joints between the ends of the walls (12) could be provided, such as for example grids or similar.

In FIG. 1A two orifices (16) performed in the outer casing (10) can also be seen. Said orifices (16) are part of coupling means of the storage tube according to the preferred embodiment of the invention, shown in more detail in FIGS. 2A and 2B. Said coupling means are used to immovably hold the inner structure with respect to the outer casing (10), said coupling means being able to be released when the extraction of the inner structure from the outer casing (10) is required to fill the storage tube with unit doses, or for dispensing unit doses from said storage tube.

Figure 2A:
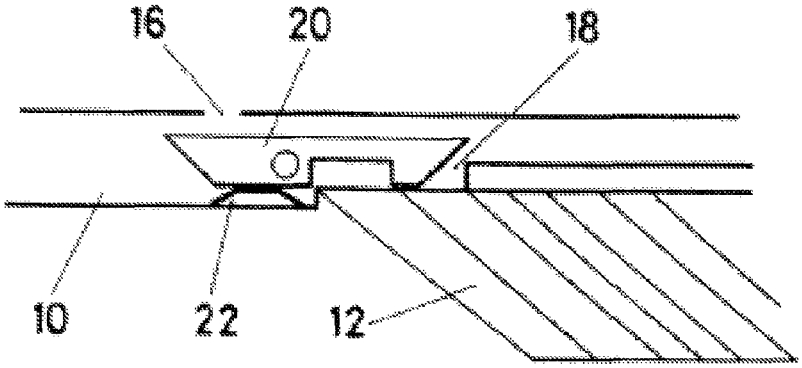
FIGS. 2A and 2B show cross-sectional views of coupling means for immovably holding the inner structure with respect to the outer casing of the storage tube according to the preferred embodiment of the invention.
Figure 2B:
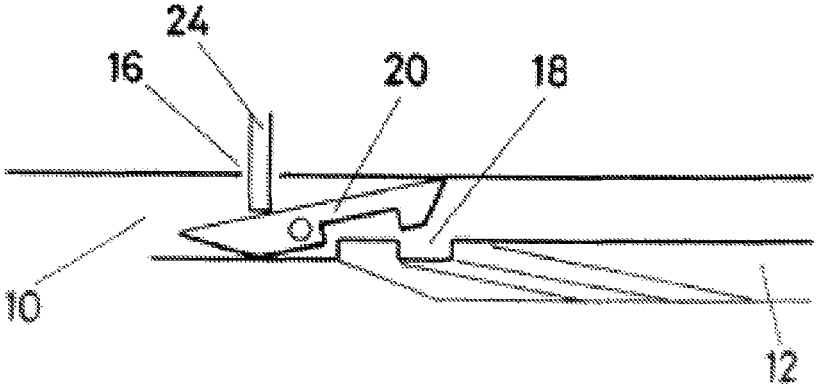

According to the preferred embodiment shown in FIGS. 2A and 2B, said coupling means of the storage tube comprise two notches (18) (only one is shown) made in the outer face of one of said walls (12) of the inner structure; two pawls (20) (only one is shown) on the inner face of the outer casing (10), mounted pivoting on an axis. One of the ends of said pawls (20) has a shape complementary to that of the corresponding notch (18), so that in a first position said end of the pawl (20) is inserted in the notch (18) immovably holding the inner structure with respect to the casing (10). The coupling means comprise also two springs (22) (only one is shown) that propel the corresponding pawl (20) towards the first immobilization position of the inner structure; as well as the two orifices (16) (shown in the FIG. 1A above) performed in the outer casing (10) and located opposite to each of said pawls (20). These orifices (16) allow the introduction of respective bolts (24) from an external device (for example, a filling device of storage tube or a dispensing cabinet, as described below in the present document) for pivoting the corresponding pawl (20) against its respective spring (22) towards a second position of release of the inner structure.

Obviously, although two orifices (16) are shown in these figures (and therefore two notches (18), two pawls (20) and two springs (22) are described), it will be obvious to the skilled in the art that the number of these elements does not affect the functioning of the present invention, and any other number of such elements may be provided that still fulfills the purpose of immovably holding the inner structure with respect to the outer casing (10) of the storage tube.

Although it is not shown in the figures, the storage tube for unit doses of medications comprises, according to the preferred embodiment of the invention, a chip (which may be injected in the tube, particularly in the case that it is of plastic) for storing data about the content of said storage tube (such as the national drug code, date and time of filling, batch, expiry date and quantity). The chip can also be activated, if the medication requires temperature control, to take temperatures of storage and/or transport. In this way, therefore, a reliable and automatic registering of the content of each storage tube is allowed.

Figure 3:
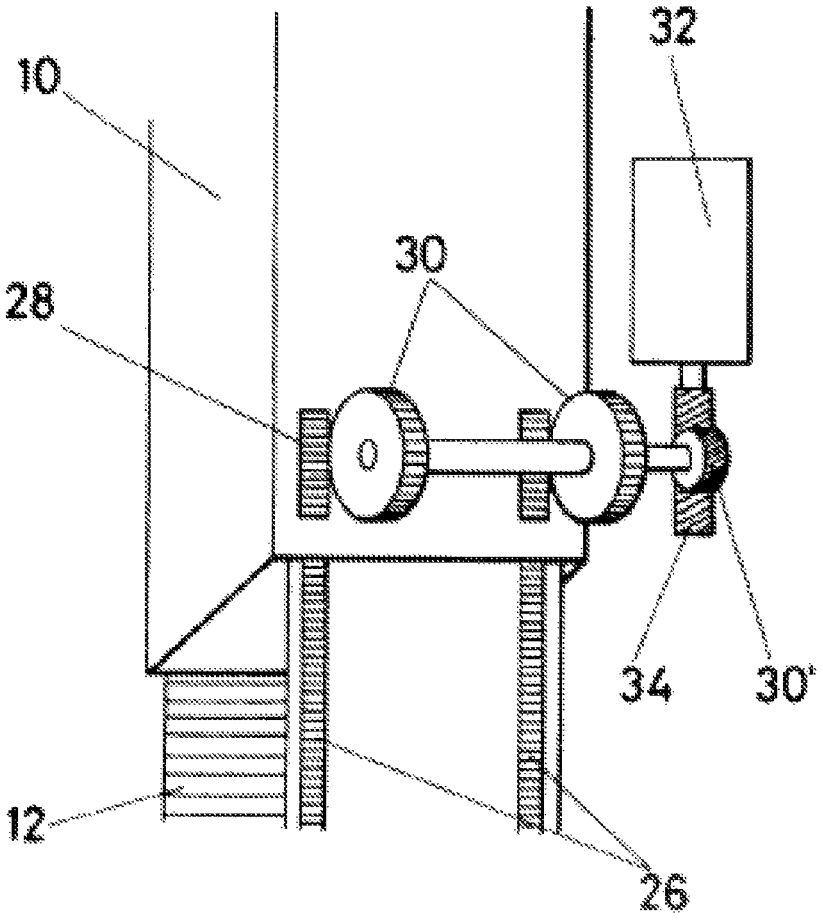
FIG. 3 shows a perspective view of traction means for inserting and extracting the inner structure from the outer casing of the storage tube according to the preferred embodiment of the present invention.

Referring now to both FIG. 1B and FIG. 3, it is observed that the storage tube further comprises traction means, that preferably comprise racks (26) arranged on the outer face of one of said walls (12) as well as traction windows (28) arranged on the outer casing (10) and that allow the access to said racks (26). Said racks (26) are suitable for their coupling with gear wheels (30) of a motorized gear train present in an external device (such as the filling device or the dispensing cabinet as described later in the present document) in which the storage tube is inserted.

In FIG. 3 the corresponding traction means present in a filling device or a dispensing cabinet according to the present invention are shown. Said traction means comprise a motor (32); an endless screw (34) connected to said motor (32); and a gear train. Said gear train comprises for its part a gear wheel (30') in contact with said endless screw (34), and gear wheels (30) corresponding to each of the traction windows (28) present in the casing (10) of the storage tube, to come into contact with each of the racks (26) in said inner structure.

Therefore, it is observed that the activation of the motor (32) in a first direction or in a second direction causes the extraction or the introduction, respectively, of the inner structure with respect to the outer casing (10) of the storage tube.

Next, a filling device according to the preferred embodiment of the invention will be described, of a storage tube for unit doses of medications as described above.

Figure 4A:
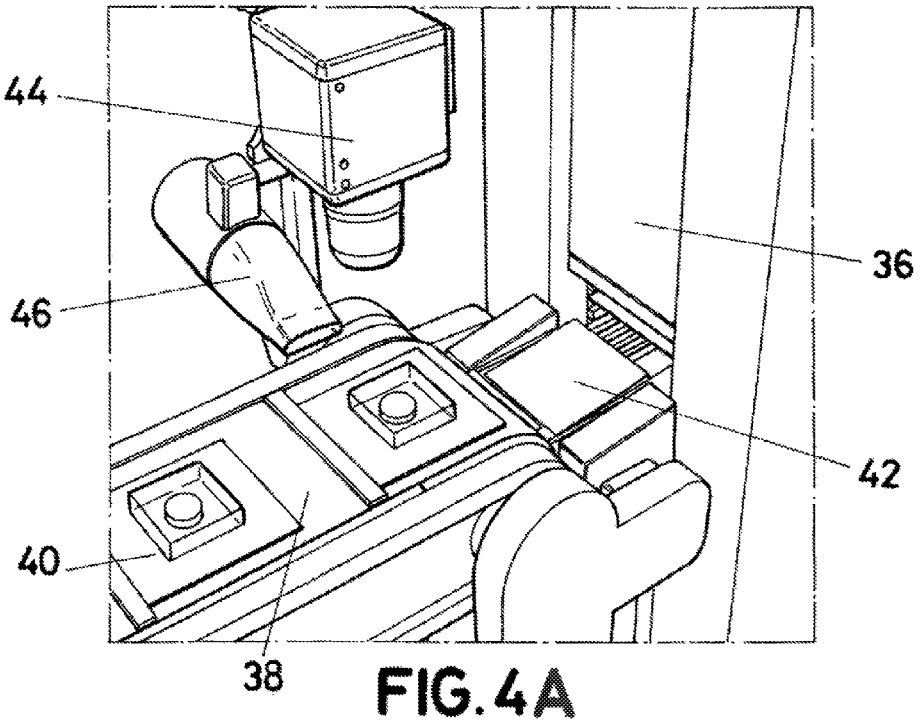
FIG. 4 shows a perspective view of a filling device of the storage tube according to the preferred embodiment of the present invention.
Figure 4B:
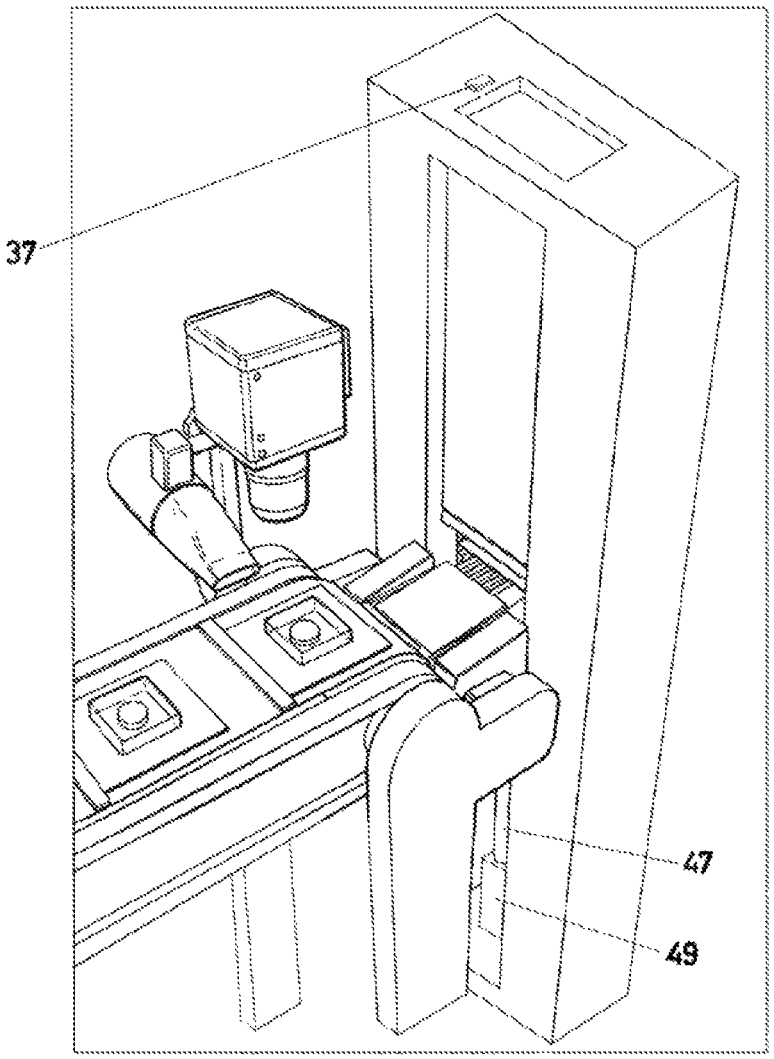

In FIG. 4, a filling device of this type is shown, comprising a housing (36) in which a storage tube for unit doses of medications as described above is inserted; traction means (shown by way of example in FIG. 3) to extract the inner structure from the outer casing (10) and to insert the inner structure into the outer casing (10); and a conveyor belt (38) for the arrival of blisters (40) with unit doses of medications inside said inner structure.

Initially, when the storage tube is inserted into its housing (36), the traction means described above completely extract the inner structure from its outer casing (10). The filling device then enters a first blister (40) between two channels of the inner structure, and the traction means are activated to insert the inner structure into its outer casing (10) a certain quantity of channels, providing thereby sufficient space for the introduction of a new blister (40) between two respective channels.

As seen in FIG. 4, the filling device further comprises a carrier tray (42) of unit doses of medications arranged between the conveyor belt (38) and the housing (36). This carrying tray (42) allows transporting the unit doses of medications from said conveyor belt (38) to the inside of the inner structure, filling the gap between them according to this preferred embodiment of the invention. This way, a more precise introduction of the unit dose between two channels of the inner structure is provided.

Furthermore, according to the preferred embodiment, the filling device further comprises an artificial vision camera (44) arranged on the conveyor belt (38) and directed towards said conveyor belt (38). This camera (44) determines the size of the unit dose of medication that is introduced into the storage tube, thus determining the number of channels of the inner structure that said inner structure must be introduced into its outer casing (10) by the motor (32) to allow a maximum utilization of the capacity of the inner structure while providing sufficient space for the introduction of said unit doses of medication. That is, in the case in which the unit doses are in the form of flat tablets, the camera (44) will determine that the inner structure must be inserted into its casing (10) a length corresponding for example to two channels between two consecutive unit dose blisters (40). However, in the case in which the unit doses are in the form of pre-filled syringes, the camera (44) will determine that the inner structure must be inserted into its casing (10) a length corresponding for example to five channels between two consecutive unit dose blisters (40).

Furthermore, according to the preferred embodiment of the invention, the artificial vision camera (44) also verifies the identity of the unit dose of medication. In the case that the artificial vision camera (44) detects that the detected identity of said unit dose of medication is not no adequate, a blower (46) located on one side of the conveyor belt (38), at the level of the unit doses of medication that are moving on the conveyor belt (38), will expel by blowing the corresponding unit dose of medication.

Although not shown in the figure, the filling device according to the preferred embodiment of the invention also preferably comprises a bolt (24) movable between an extended position and a retracted position, arranged to be inserted in extended position in each of the orifices (16) performed in the outer casing (10) of the storage tube described above. These bolts (24) will act in conjunction with the coupling means of the storage tube described above for immovably holding the inner structure with respect to the outer casing (10) while the filling of it with unit doses of medications is performed. In this case, the filling device further comprises a push button (not shown) to move said bolt towards its retracted position, removing it from the respective orifice (16) and thereby allowing the return of the pawl (20) to the position that immobilizes the inner structure with respect to the outer casing (10), thereby allowing the extraction of the storage tube from its housing (36).

Although neither shown in FIG. 4, the filling device also preferably comprises an ejecting spring of the storage tube. Said spring is compressed when inserting the storage tube into the housing (36) and fixing the outer casing (10) in its place by said bolt. When the bolt is moved towards its retracted position by the push button, said spring automatically ejects the storage tube from the housing (36).

As mentioned above in the present document, according to the preferred embodiment of the invention, the storage tube comprises a chip for storing data about the content of said storage tube. In this case, the filling device also preferably comprises writing means in the chip of the storage tube. Said writing means initially erase the data contained in the chip of said storage tube when inserting it into the housing (36), before introducing unit doses of medications into said storage tube. Later, after having filled the storage tube with unit doses and before ejecting it from its housing (36), the writing means write data about the unit doses of medication stored in said storage tube.

Figure 5:
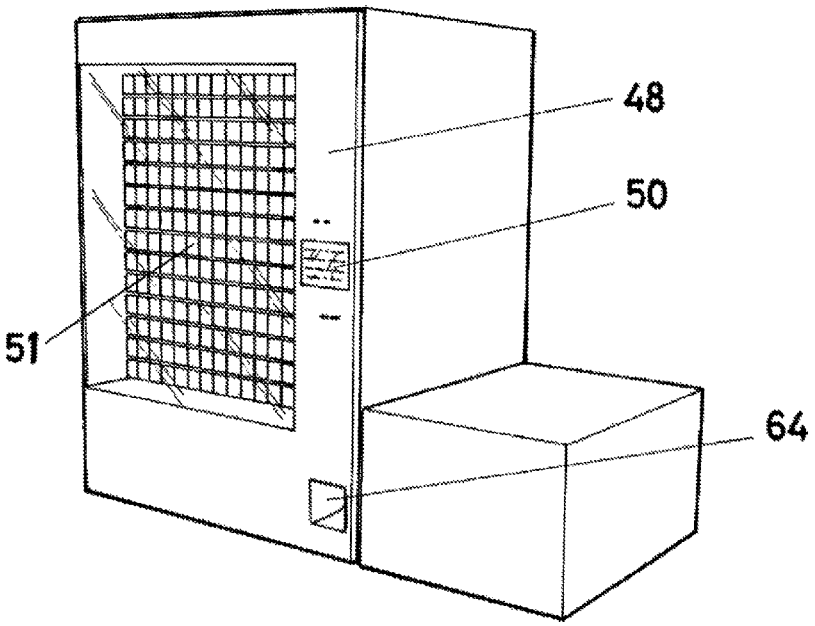
FIG. 5 shows a front perspective view of a dispensing cabinet according to the preferred embodiment of the present invention.
Figure 6:
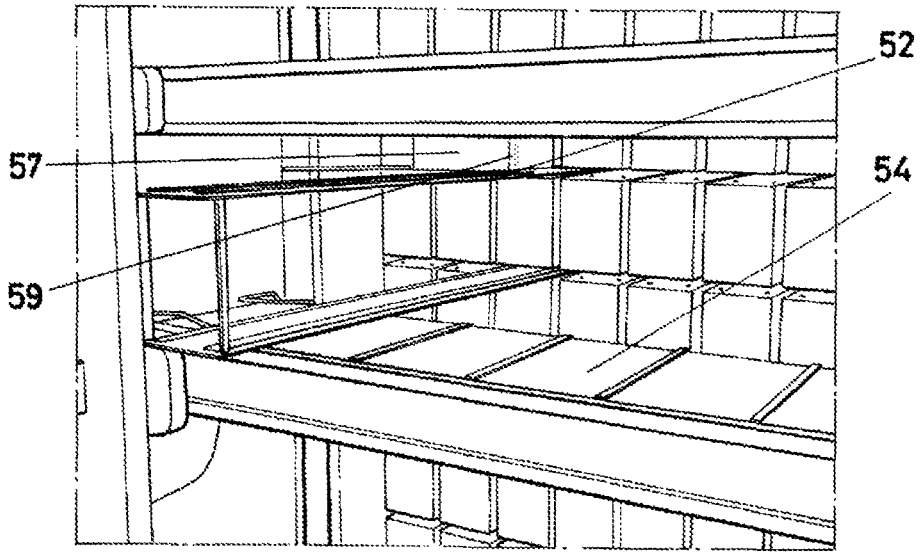
FIG. 6 shows a perspective view of the hoist and associated elements of the cabinet shown in FIG. 5.
Figure 7:
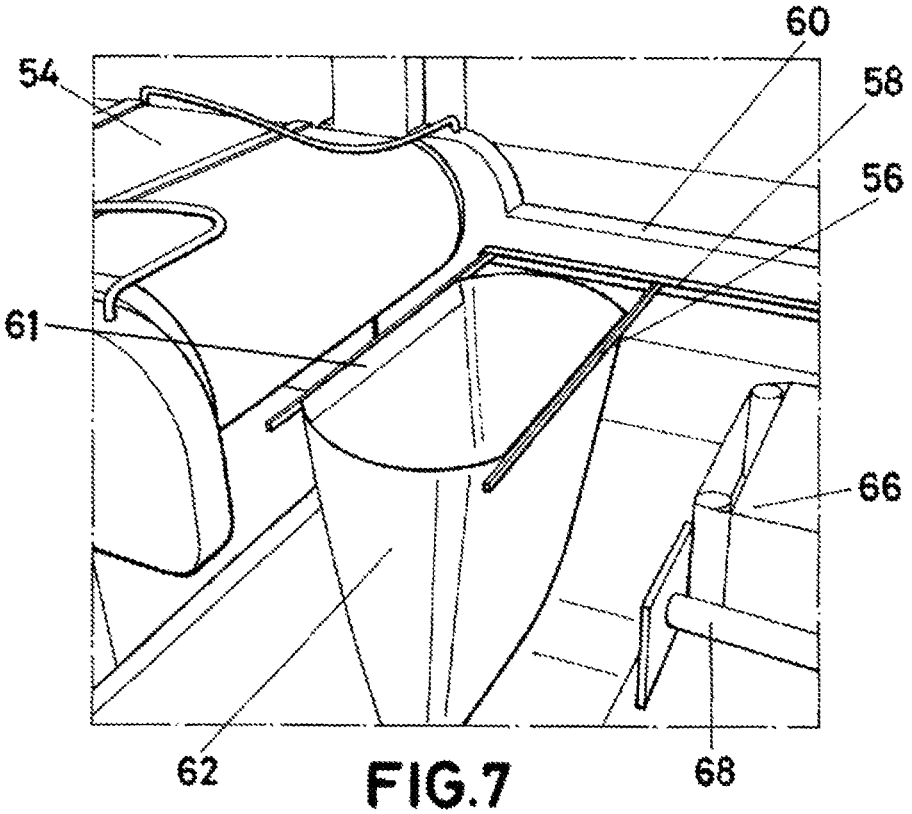
FIG. 7 shows a perspective view of the collection bag and associated elements of the cabinet shown in FIG. 5.

Referring now to FIGS. 5, 6 and 7, a medication dispensing cabinet according to the preferred embodiment of the invention is shown, from storage tubes previously described in the present document. The dispensing cabinet comprises:

- an outer body (48);
- a touch screen (50) for introducing information about the request of unit doses of medications;
- a plurality of housings, each housing being suitable to house a storage tube for unit doses of medications;
- anchoring means (for example, as the ones described above in reference to the filling device) of each storage tube in its respective housing;

a hoist (52) arranged to move to any of the plurality of housings according to the information about the request of unit doses of medications;

traction means (for example, such as the ones described above in reference to the filling device) in said hoist (52) to extract each inner structure from its outer casing (10) of the storage tube and respectively insert each inner structure into its outer casing (10), as needed;

a conveyor belt (54) joined in solidarity movement with said hoist (52);

means (not shown) for ejecting a blister with unit dose of medication from an inner structure of storage tube extracted by said traction means to said conveyor belt (54);

a pair of clamps (56), being one of their ends inserted into a guide rail (58) present in a lateral projection (60) of said hoist (52);

a collection bag (62) held in open position by said clamps (56) and arranged to receive unit doses of medications carried by said conveyor belt (54);

closure means of said collection bag (62) once all unit doses of medications have been introduced;

an horizontal printer (66) with a detacher of roll labels, to provide a label with information about the unit doses of medications introduced into the collection bag (62);

a vacuum piston (68) that sucks a label from the horizontal printer (66) to its adhesion to the collection bag (62); and an output channel (64) of the closed bag outwards.

Furthermore, according to the preferred embodiment of the invention, the touch screen (50) also comprises locking means thereof, so that its use is only allowed after identifying that the user has the corresponding authorization. Said locking means may consist for example in a bar code reader in a user identification card, in locking means by password, a digital fingerprint reader, etc.

The closure means of the collection bag (62) mentioned above may be any bag closure means commonly known in the art. Preferably, said closure means consist in a heat sealer of said collection bag (62).

Although it is not shown in the figures, the dispensing cabinet according to the preferred embodiment of the invention further comprises an optical detection system, for example by a laser beam emitter and an opposite optical receiver, arranged to detect the number of unit doses of medications falling from the conveyor belt (54) into the collection bag (62). This way, it is verified that the appropriate number of unit doses is introduced into the collection bag (62), and the moment in which said collection bag (62) must be closed is determined.

As mentioned above, according to the preferred embodiment the storage tube further comprises a chip for storing data about the content of said storage tube. In this case, the dispensing cabinet also preferably comprises means for reading the information contained in said data storage chip about the content of said storage tube, so that the storage tube from which the required unit dose must be extracted is precisely detected.

Furthermore, as an additional safety measure according to the preferred embodiment of the invention, the dispensing cabinet also comprises means for reading a bar code that has been previously affixed at the back of each blister of unit dose of medication. Thus, further means for the identification of the identity of the unit doses being introduced into the collection bag (62) are provided.

Finally, the present invention also discloses a method of filling a storage tube as described previously in the present document. According to the preferred embodiment, said method comprises the steps of:

a) placing the storage tube in a fixed position;

b) extracting the inner structure from its outer casing (10);

c) introducing a blister (40) with a unit dose of medication fastened between opposite channels of the walls (12) of the inner structure;

d) inserting the inner structure into its outer casing (10) a certain number of channels to provide sufficient space therein for the introduction of another blister (40) with unit dose of medication; and e) repeating steps c) and d) until the inner structure is completely inserted into its outer casing (10).

Furthermore, according to the preferred embodiment of the invention, the filling method comprises the additional step of determining the size of the unit dose of medication to be introduced into the storage tube, so that the optimal number of channels that the inner structure must be introduced into the outer casing (10) between two adjacent unit doses can be determined.

Preferably, the filling method of the present invention also comprises the additional step of determining whether an identity of a unit dose of medication to be introduced into the inner structure corresponds to an identity of unit dose of medication that must be introduced, thus allowing to expel said unit dose of medication if not corresponding, so that the contamination of a storage tube with a unit dose of a medication different from the rest of medications present in said storage tube is avoided.

As mentioned above, according to the preferred embodiment of the invention the storage tube comprises a chip to store data about the content of the storage tube. In this case, the filling method of the invention further comprises, at any point prior to step c) described above, a step of erasing the information of the chip present in said storage tube, as well as a final step, after step e) of writing data in the chip about the unit doses of medication stored in said storage tube.

Although the present invention has been described in reference to specific embodiments thereof, those skilled in the art will understand that such embodiments are not limitative of the invention, and will be able to apply modifications and variations thereof without departing from the scope of the enclosed claims. For example, although a dispensing cabinet having a touch screen for introducing information about the request of unit doses of medications has been described, alternative embodiments of the invention will present alternative means for the introduction of such information, such as for example via a wireless connection (for example bluetooth or another) to an external device (for example, a portable electronic device carried by the doctor or the nurse) or by an Internet connection to an external device (such as for example a personal computer).

Furthermore, although it has also been described a cabinet that has a horizontal printer with a detacher of roll labels as well as a vacuum piston to affix the label produced to the collection bag, it is understood that other means can be provided for writing and affixing said label to the bag. Additionally, other means for issuing said label to the exterior can also be provided, for example by a slot, without the need to be attached to said collection bag.

The materials used to manufacture each of the elements disclosed in the present document are not limited in any way, and any material that provides the required characteristics can be used. For example, the outer casing of the storage tube is preferably made of, but not limited to, resistant plastic, to allow a simple manufacturing method (for example by molding) as well as a sufficient resistance in case of falling.

Lastly, preferred embodiments have been described in which the storage tube comprises a chip on which to store data, and in this case the filling device and the dispensing cabinet comprise writing means and reading means, respectively, of said chip. However, the skilled in the art will easily understand that alternative embodiments of the invention may be devised which lack said chip and thus said writing means and reading means in said chip. Nevertheless, in this case a greater involvement by the operators will be required to manually enter the storage tubes into the filling device, programming the device with the type of unit dose of medication to be introduced into that storage tube. Also, an operator should manually insert the filling tubes into specific housings of the dispensing cabinet, and program this position in the dispensing cabinet. Thus, the dispensation of the different unit doses of medication will be provided in function of the position of each storage tube (since each position will correspond to a specific identity of unit dose of medication).

The invention claimed is:

1. A storage tube for unit doses of medications comprising:

an outer casing having a first open end and a second open end;

an inner structure within the outer casing, the inner structure comprising a first wall and a second wall opposite and symmetrical to the first wall, the first wall having a first end, the second wall having a second end joined to the first end, the first wall having a first ribbed inner face defining a first channel, the second wall having a second ribbed inner face defining a second channel opposite the first channel, the first and second channels configured to receive a blister containing a unit dose of medication; and traction means for inserting and extracting the inner structure from the outer casing.

2. The storage tube for unit doses of medications according to claim 1 wherein the traction means comprise racks and traction windows, the racks arranged on an outer face of at least one of the first and second walls, the traction windows arranged on the outer casing and configured to allow access to the racks, and wherein the racks are adapted to couple with gear wheels of a motorized gear train of an external device in which the storage tube is inserted.

3. The storage tube for unit doses of medications according to claim 2, further comprising:

coupling means for immovably retaining the inner structure relative to the outer casing, wherein the coupling means releasably couples the inner structure to the outer casing.

4. The storage tube for unit doses of medications according to claim 3, wherein the coupling means includes, at least one notch defined in the outer face of at least one of the first wall or the second wall of the inner structure, a pawl disposed on an inner face of the outer casing and pivotally mounted on an axis, the at least one notch configured to receive an end of the pawl such that in a first position the end of the pawl is inserted in the notch to immovably hold the inner structure with respect to the outer casing;

a spring configured to propel the pawl towards the first position an orifice formed in the outer casing and located opposite the pawl, the orifice configured to receive a bolt from an external device for pivoting the pawl against the spring towards a second position to release the inner structure.

5. The storage tube for unit doses of medications according to claim 4 further comprising:

a chip for storing data about a content of the storage tube.

6. A filling device for a storage tube for unit doses of medications, the filling device comprising:

a housing configured to receive the storage tube for unit doses of medications;

traction means configured to (i) extract an inner structure of the storage tube from an outer casing of the storage tube and to (ii) insert the inner structure into the outer casing; and a conveyor belt configured to transport blisters with unit doses of medications into the inner structure.

7. The filling device according to claim 6 further comprising:

a carrier tray having unit doses of medications, the carrier tray arranged between the conveyor belt and the housing and adapted to transport the unit doses of medications from the conveyor belt to the inner structure.

8. The filling device according to claim 7, wherein the traction means comprises:

a screw connected to a motor;

a gear train comprising a first gear wheel and a second gear wheel, the first gear wheel in contact with the screw, the second gear wheel corresponding to a traction window arranged on the outer casing and configured to contact a rack arranged on an outer face of a wall in the inner structure whereby activation of the motor in a first direction or in a second direction causes the extraction or the insertion, respectively, of the inner structure with respect to the outer casing.

9. The filling device according to claim 6, further comprising:

a bolt movable between an extended position and a retracted position, the bolt arranged to be inserted in the extended position in an orifice formed in the outer casing of the storage tube and located opposite a pawl, the bolt configured to pivot the pawl against a spring to (i) release the inner structure with respect to the outer casing and (ii) immovably fix the outer casing with respect to the housing; and a push button configured to move the bolt towards the retracted position and out of the orifice and thereby allow (i) the pawl to immobilize the inner structure with respect to the outer casing and (ii) the extraction of the storage tube from the housing.

10. The filling device according to claim 9, further comprising:

an ejecting spring configured to be compressed when inserting the storage tube into the housing and fixing the outer casing with the bolt, and wherein the ejecting spring is configured to eject the storage tube from the housing upon moving the bolt towards the retracted position.

11. The filling device according to claim 6, further comprising:

an artificial vision camera arranged on the conveyor belt and directed towards the conveyor belt, the artificial vision camera adapted to determine a size of the unit dose of medication introduced into the storage tube thereby determining a number of channels of the inner structure that must be introduced into the outer casing to allow a maximum utilization of a capacity of the inner structure while providing space for the introduction of the unit doses of medication.

12. The filling device according to claim 11, for filling a storage tube described in claim 6, further comprising:

writing means in a chip of the storage tube, the chip configured to (i) erase data contained in the chip of the storage tube upon inserting the storage tube into the housing, and (ii) write data identifying the unit doses of medication stored in the storage tube before ejecting the storage tube from the housing, the chip configured to store data about a content of the storage tube.

13. A medication dispensing cabinet for a storage tube, the medication dispensing cabinet comprising:

an outer body;

means for introducing information about a request of unit doses of medications;

a plurality of housings, each housing adapted for storing a storage tube for unit doses of medications;

anchoring means to anchor the storage tube in a housing of the plurality of housings;

a hoist arranged to move to any of the plurality of housings according to the information about the request of unit doses of medications;

traction means in the hoist, the traction means configured to (i) extract an inner structure of the storage tube from an outer casing of storage tube and to (ii) insert the inner structure into the outer casing;

a conveyor belt configured to move with the hoist;

means for ejecting a blister with unit dose of medication from the inner structure of storage tube to the conveyor belt;

a pair of clamps, each clamp having an end inserted into a guide rail disposed in a lateral projection of the hoist;

a collection bag held in an open position by the clamps and arranged to receive unit doses of medications carried by the conveyor belt;

closure means for closing the collection bag once all unit doses of medications have been introduced into the collection bag;

writing means for writing information on a label, the information including the unit doses of medications introduced into the collection bag;

means for affixing the label to the collection bag; and an output channel configured to output the collection bag outwards.

14. The medication dispensing cabinet according to claim 13, wherein the anchoring means comprises a bolt movable between an extended position and a retracted position, the bolt arranged to be inserted in the extended position in an orifice formed in the outer casing of the storage tube, the orifice located opposite to a pawl, the bolt configured to pivot the pawl against a spring to release the inner structure and immovably fix the outer casing with respect to the housing, the anchoring means further comprising means to move the bolt towards the retracted position and remove the bolt from the orifice thereby allowing the pawl to immobilize the inner structure with respect to the outer casing, thereby allowing the extraction of the storage tube from the housing.

15. The medication dispensing cabinet according to claim 13, wherein the hoist of the traction means comprises:

a motor;

an endless screw connected to the motor; and a gear train comprising a first gear wheel and a second gear wheel, the first gear wheel in contact with the endless screw, the second gear wheel corresponding to a traction window defined in the casing of the storage tube, the second gear configured to contact a rack in the inner structure such that activation of the motor in a first direction or in a second direction causes the extraction or the insertion, respectively, of the inner structure with respect to the outer casing.

* * * * *